United States Patent [19]

Grimes

[11] Patent Number: 4,669,166

[45] Date of Patent: Jun. 2, 1987

[54] ELECTRIC LATHE

[75] Inventor: David B. Grimes, Greenfield, Mass.

[73] Assignee: Montague Industries, Inc., Turners Falls, Mass.

[21] Appl. No.: 800,335

[22] Filed: Nov. 21, 1985

[51] Int. Cl.[4] ..... B21K 21/16; B23P 23/00; B24B 19/00

[52] U.S. Cl. ..... 29/401.1; 29/434; 29/557; 241/101.2; 51/246

[58] Field of Search ..... 29/401.1, 434, 557; 241/101.2; 51/246, 247, 248, 249, 250

[56] References Cited

U.S. PATENT DOCUMENTS

| | | | |
|---|---|---|---|
| 1,642,053 | 9/1927 | Warren | 241/101.2 |
| 2,970,779 | 2/1961 | Duty | 241/101.2 |

OTHER PUBLICATIONS

*Pulp and Paper Science and Technology,* vol. 1, Chapter 8, McGraw Hill Book Company, New York, 1962.

*Primary Examiner*—Mark Rosenbaum
*Assistant Examiner*—Irene Graves Golabi
*Attorney, Agent, or Firm*—Donald S. Holland

[57] ABSTRACT

A novel retrofit process for converting the hydraulic lathe of an existing pulp-grinding machine into the new electric one is described. This process includes utilization of the pre-existing hydraulic cylinder as a supporting housing and shield for a major portion of the drive assembly for the electric lathe. In the preferred "retrofit" embodiment, the drive for the lathe comprises a ball-screw assembly housed inside the cylinder, after the cylinder has first been evacuated. This drive assembly includes a longitudinally fixed, but rotatable "power screw" that is supported by opposite ends of the cylinder. A variable speed, reversible motor is located outside one of the cylinder ends and is coupled to the screw to selectively rotate it. A threaded collar is located inside the cylinder and straddles the screw. It carries a pair of parallel, spaced rods that extend through the end of the cylinder that is opposite the cylinder's "motor end". These rods are connected to a yoke which, in turn, is connected to the standard carriage-carrying burr mandrel or "dressing wheel" used in the prior hydraulic lathe.

11 Claims, 9 Drawing Figures

ELECTRIC LATHE

BACKGROUND OF THE INVENTION

This invention relates to lathes and more particularly to lathes that sharpen the cylindrical grinding stones used in pulp-making machinery.

Since the invention of "pulp" paper, wood has been traditionally ground into pulp. This soft, moist mass is then combined with various additional fibers to produce the type of paper most often used today.

To make the pulp, large grinders have been used. One such machine is the Great Northern Waterous Grinder manufactured by the assignee of the present invention, Montague Industries, Inc. (d.b.a. Montague Machine Co.) of Turners Falls, Mass.

To use the "Great Northern" (shown in FIG. 1), logs are first loaded into a top chute or hopper. From there, they fall into an underlying pocket or grinding chamber where they are pressed against a cylindrical grinding stone by a hydraulically operated piston. The stone then rotates to break down the logs and grind them into fine particles. As it does, the particles are mixed with water to form the pulp.

The "pulp stone" has a series of helical grooves in its grinding surface. These grooves spiral around the stone's central, rotational axis and, though they intersect, they are parallel to one another.

During the stone's rotation, these grooves help to break down the logs. In addition to initially catching the log ends to assist in snapping the logs, they also provide a series of sharp, helical cutting edges or shoulders to subsequently slice large log pieces into small ones.

Over time, the outer surface of the cylindrical stone becomes worn, the side edges of the grooves become dull and the grooves become shallow. At that point, the helical pattern on the stone needs to be resharpened or "dressed".

As with most grinders, the Great Northern Waterous Grinder comes equipped with its own hydraulically operated lathe. This lathe has a dressing wheel which is mounted on a hydraulically movable carriage that travels axially across the top of the grinding stone. As it moves, the wheel hopefully recuts the helical pattern that has been eroded. Ideally, the shoulders of each groove should be squared and the grooves made deep again.

The cutting surface on the wheel comprises several parallel helices of discrete burr teeth. Each set of teeth or burrs is supposed to ride in an underlying aligned groove during an axial movement of the wheel across the stone.

It is important that these burrs constantly mesh with the old grooves during resharpening. If the linear velocity of the carriage-carrying wheel changes during a pass across the stone, the helices of the burrs and grooves will not align and the wheel tends to pop out of the grooves.

One of the problems with the water-driven system is that the water pressure fluctuates. This causes a velocity change and results in the burrs leaving the grooves and scarring the stone.

Another problem is caused by creepage of the carrier when the water source is turned off. Due to internal build-up of pressure inside the system's hydraulic cylinder, the system's carriage-moving piston tends to edge forward when the water is shut off. This can cause the burrs to slowly leave the grooves and chip the grooves' lead shoulders.

Maintenance problems also occur with all the pulp grinders that use the prior hydraulic system. Since the speed of each lathe varies as the particular system's packings and cylinder lining wear, the system needs to be constantly monitored for wearage. Otherwise, "last months" water pressure may cause the carriage to move too quickly.

SUMMARY OF THE INVENTION

To overcome these problems, Applicant has developed a novel method and apparatus for converting the existing hydraulic lathe of prior pulp-grinding machines into a new electric one.

The preferred method is a simple retrofit process. It basically includes installing a ball screw inside the existing hydraulic cylinder and attaching a variable speed, reversible drive motor to the ball screw.

In the preferred embodiment, a threaded collar is mounted atop the screw for axial movement inside the cylinder. This collar carries a pair of spaced, parallel push rods that extend through a free end of the cylinder. On the outside of the cylinder, the rods are connected to a yoke which, in turn, is connected to the standard carriage-carrying burr mandrel or dressing wheel used in prior machines.

When the motor is turned on, a user can precisely control the rotation of the screw and the concomittant movement of the collar along it. As the collar moves, it "pushes" the rods in or out of the cylinder like a trombone slide. The slide, in turn, carries the dressing wheel and causes it to make a controlled sharpening pass across the pulp stone.

With this electronic device, the linear speed of the carriage-carrying burr can be accurately maintained to crisply reshape the existing grooves of the pulp-grinding stone. No longer does the dressing wheel fall out of the grooves, because now the linear speed of the wheel can be constantly maintained to precisely track the grooves' helices during rotation.

Unlike the prior hydraulic drive system, when the present electric one is shut off, its carriage-carrying wheel stops immediately. No longer does the wheel ride over the grooves' shoulders and chip their edges.

With the present system, maintenance is much easier. In the past, the hydraulic system had to be machined or fixed in the shop. But, with the present system, there is no need for cylinder relining, valve replacement or piston-and-follower repair. There is less downtime.

Prior to Applicant's invention, another company tried to make an effective electric lathe: F. W. Roberts Inc. of Lockport, New York. That lathe is an original equipment item that is marketed as part of an overall pulp-grinding machine, called the "Roberts Ring Grinder".

Unfortunately, the Roberts lathe has an "exposed" screw drive for its carriage. That drive is mounted within a cylindrical housing for both the lathe and the machine's pulp stone; and, it is mounted perilously close to the stone. Consequently, during resharpening and even pulp grinding, carbide grit flies forth from the stone and gets into the threads of the exposed power screw. This contamination causes jamming and accelerated wear.

To prevent this problem, Applicant utilizes the preexisting hydraulic cylinder of the Great Northern Waterous Grinder. By encasing the present screw drive into this cylinder, the threads are shielded from the dust and contamination is avoided.

Utilizing the existing cylinder has two other advantages —speed in conversion and reduction of cost. By saving and using most of the replaced lathe's parts, including the lathe's cylinder casing and its dressing wheel, there is a ready-made structure for quickly switching over the hydraulic lathe into the unique electric lathe described herein.

BRIEF DESCRIPTION OF THE DRAWINGS

With the foregoing background and objectives of the invention in mind, reference is made to the accompanying drawings in which.

DETAILED DESCRIPTION OF THE PREFERRED EMBODIMENT

Figure 1:
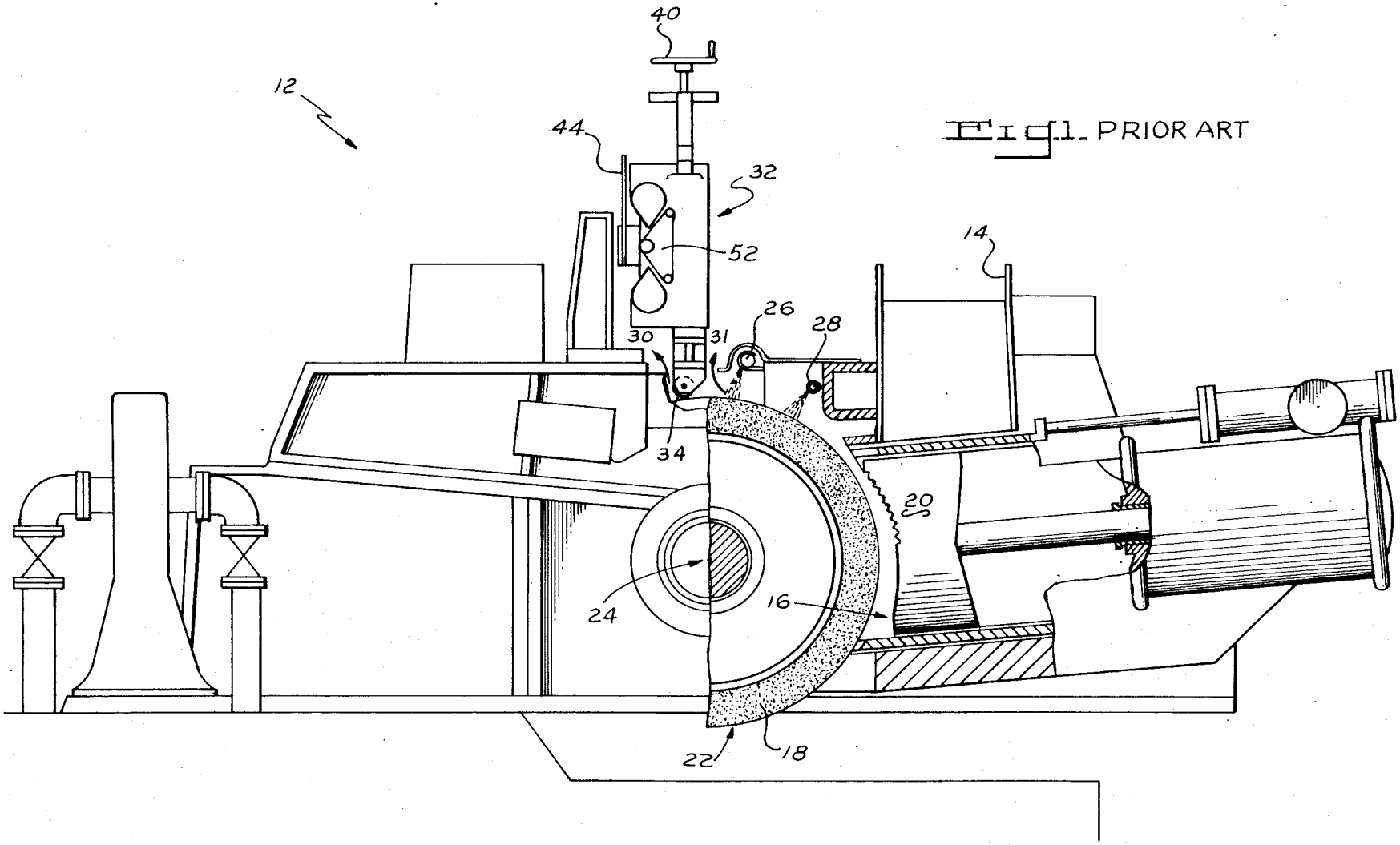
FIG. 1. PRIOR ART
FIG. 1 is a schematic side view of the aforementioned Great Northern Waterous Grinder in basic outline form, with a midportion being illustrated in cross-sectional detail to depict certain key parts.

Referring to the drawings in detail, a novel electric lathe is shown in FIGS. 4-9 and represented by the reference numeral 10. It is attachable to the top of standard pulp grinders, such as the Great Northern Waterous Grinder 12 shown in FIGS. 1-3, and can be either a retrofit or an original equipment item.

To understand the lathe 10, it is necessary to first understand the environment in which it works—namely, the pulp-grinding machines for which the invention was designed. As best shown in FIG. 1, these prior machines typically include a top chute or hopper 14 into which logs (not shown) are first loaded. From there, the logs fall into an underlying pocket or grinding chamber 16, where they are pressed against a cylindrical grinding stone 18 by a hydraulically operated piston 20. The "pulp stone" 18, typically carbide, then rotates to break down the logs and grind them into fine particles. As it does, the particles are mixed with water to form the pulp.

The "pulp stone" 18 has a series of helical grooves (not shown) that extend the entire length of its grinding surface 22. They spiral around the stone's central, rotational axis 24 at the same rate, and they are parallel to one another.

During the stone's rotation, the helical cutting edges or shoulders of the grooves help to break down the logs. To assist in breakdown and to prevent undue wear of the shoulders, water is sprayed onto the grooves through nozzles 26, 28. This spray also mixes with sawdust near the top of the stone. Most of this mixture falls into grinding chamber 16. However, some grit escapes. As shown by directional arrows 30, 31, this grit escapes out an upper opening of the Great Northern Machine, where it contaminates any exposed gearing on overlying parts.

Over time, the grooves become subject to wear and need to be rehoned. To achieve this, the Great Northern has previously used a hydraulic lathe 32. This lathe includes a dressing wheel 34 with a series of burrs (not shown). The wheel pivots within a U-shaped housing 36, which is part of an integral, vertically movable pillar 37 that is threaded onto a spindel 38.

An overlying bell crank 40 is attached to the top of the spindle via interconnecting rod 41. By turning the crank clockwise, the pillar and dressing wheel 34 can be lowered to fit the burrs 34 into the worn grooves. Or, by turning the crank counterclockwise, the burrs can be raised away from the stone's grinding surface 22. In either event, a pointer 42 always indicates the height of the burrs.

To sharpen the grooves, the burrs are first lowered into the grooves. Afterwards, an operator pulls an operating lever 44. This causes water to flow into hydraulic cylinder 46 and push out piston arm 48.

Piston arm 48 has a threaded end 50. This end passes through a triangular yoke 52 and is connected to the yoke via nut 53. The yoke, in turn, is connected in a similar manner to a pair of parallel, upper and lower rods or arms 54, 56.

Figure 2:
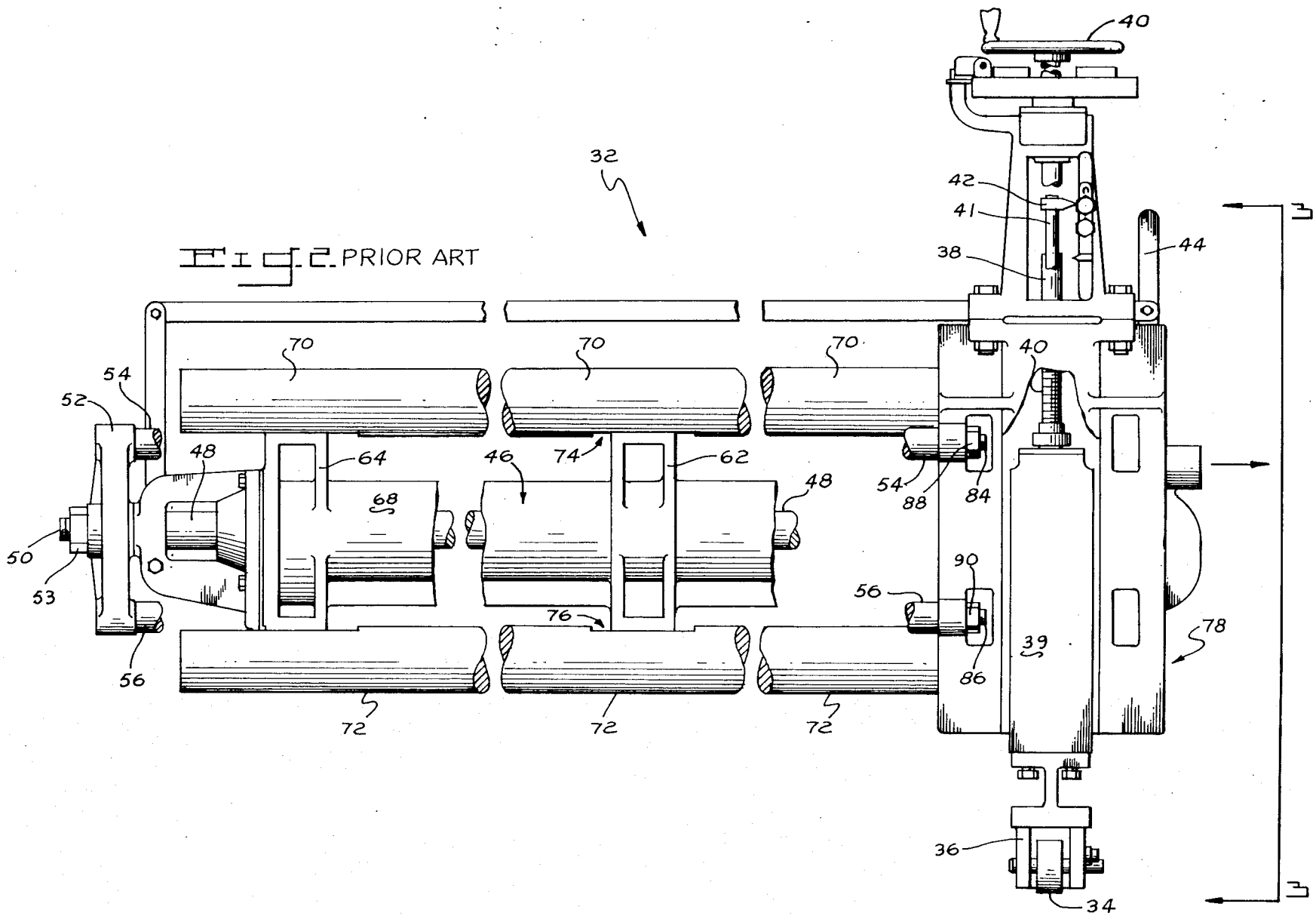
FIG. 2 PRIOR ART
FIG. 2 is a fragmentary view of a prior art, hydraulic lathe shown in FIG. 1.
Figure 4:
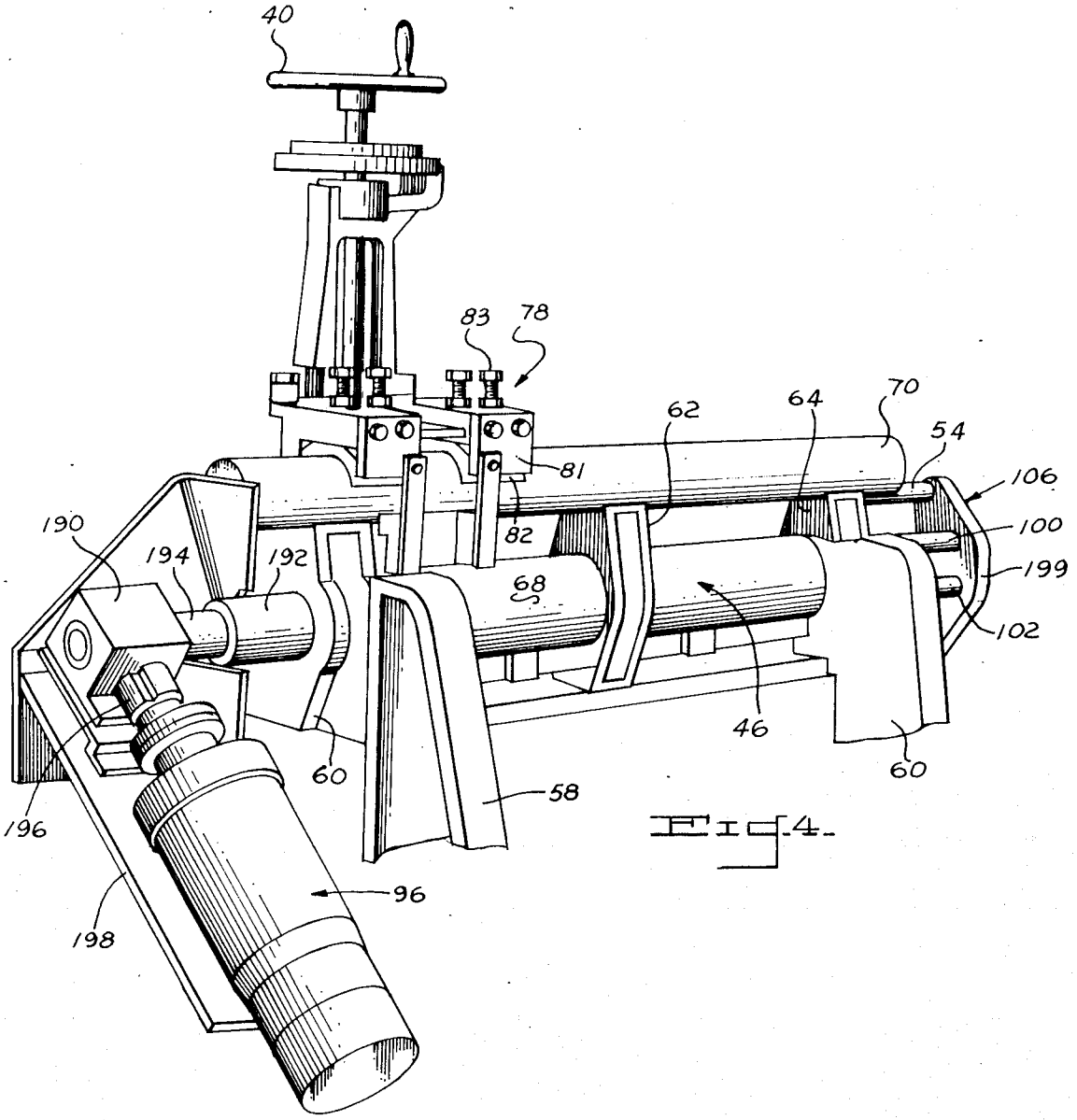
FIG. 4 is a perspective view of an electric, retrofit lathe that is used to replace the FIG. 2 lathe and which is constructed in accordance with the present invention.

Referring to FIGS. 2 and 4, the hydraulic cylinder 46 is fixedly mounted atop machine 12 via a pair of vertical supports 58, 60. This cylinder has a trio of vertical, anvil-shaped flanges 62, 64, 66. These flanges are equidistantly spaced along the cylinder's housing 68, with two of the flanges occurring at the opposite ends of the housing and the other occurring at the housing's midpoint.

Flanges 62, 64, 66 serve as mounting support for fixedly attaching a pair of upper and lower guide arms 70, 72. These guides have a series of opposing niches 74, 76. These niches allow the arms to rest securely against the flat top and bottom surfaces of the "anvil" flanges 62, 64 and 66.

Referring to FIGS. 2 and 4, the dressing wheel 34 and bell crank 40 are connected to opposite ends of a C-shaped carriage 78. This carriage "clips onto" and overhangs the guide arms 70, 72 for slidable movement along them. Each of the carriage's overhanging portions includes a horizontal arm 80, an attached vertical plate 81 and an insertable arcuate brass sleeve or bearing 82. After the carriage is loosely fitted atop the guides, tightening screws 84 can be used to create a tighter fit between the brass and its adjacent guide arm (70 or 72).

Carriage 78 is fixedly connected to the threaded ends 84, 86 of apaced arms 54, 56 via hex nuts 88, 90. Therefore, as the water pushes the piston arm 48 out of cylinder 46, the attached yoke 52 and arms 56, 58 move like a trombone slide and carry the carriage 78 with them. In doing so, the wheel makes a sharpening pass across the "pulp stone" 18.

After a pass is made, the handle 44 is returned to its original position shown in FIG. 2. Next, a small lever (not shown) on the underside of the lathe is flipped to redirect the flow of any future incoming water to an opposite side of the piston baffle (not shown) inside cylinder 46. Then, handle 44 is pulled down to restart the water flow, with the end result being that the incoming water forces the extended piston 48 to retract and pull the carriage 78 back with it.

It is contemplated that the present invention's most prolific use, at least initially, will be as a retrofit for converting the aforementioned hydraulic lathe 32 into a unique electric one. Accordingly, the invention 10 (shown in FIGS. 4–9) will now be described in "retrofit" terms.

Figure 3:
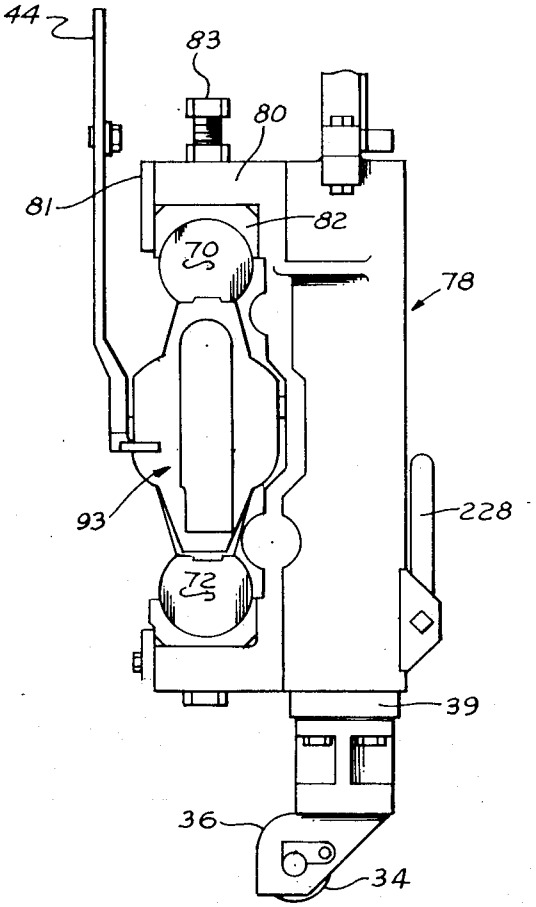
FIG. 3 PRIOR ART
FIG. 3 is a fragmentary, end plan view of the lathe taken along line 3—3 of FIG. 2.
Figures 5, 6, 7:
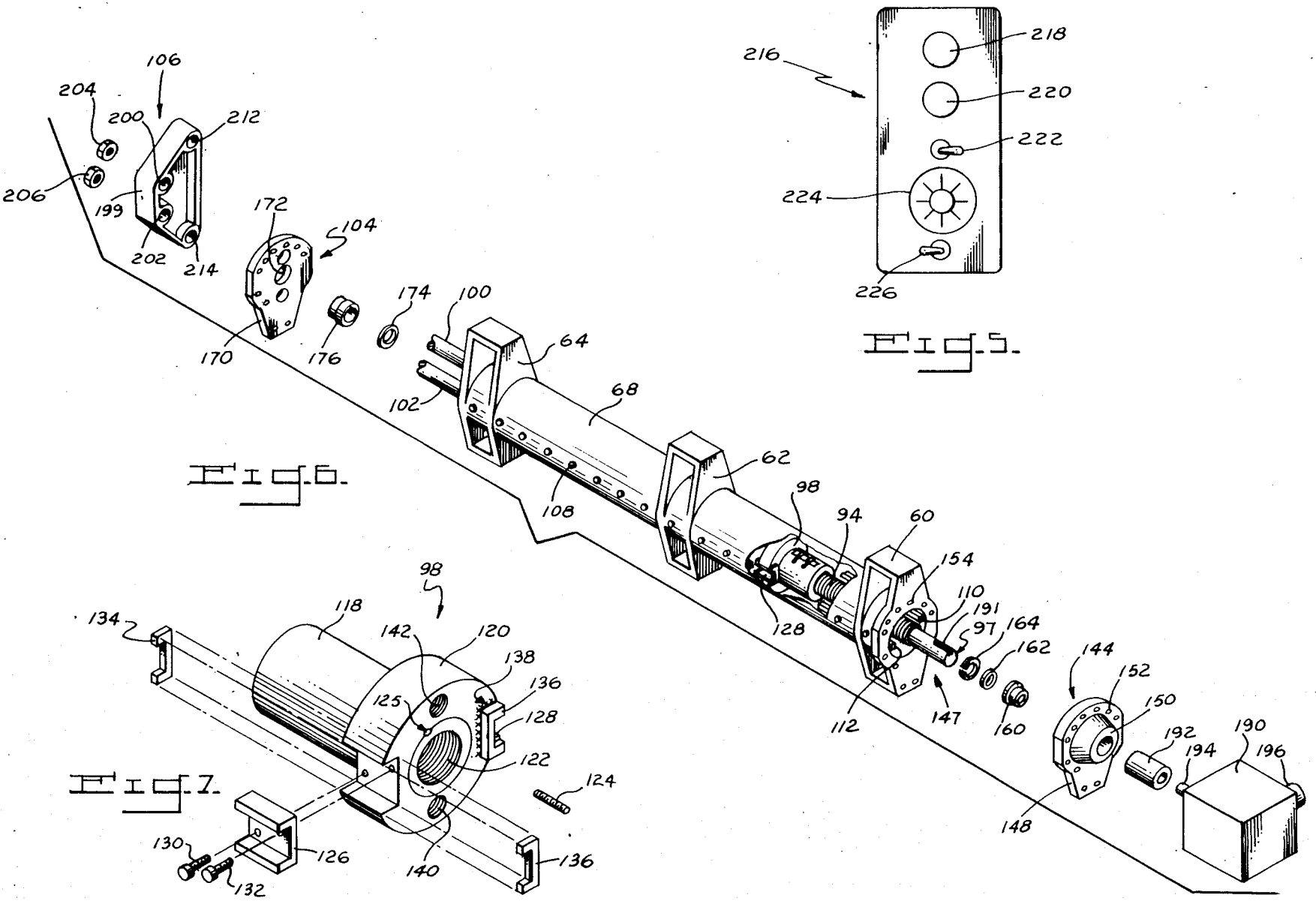
FIG. 5 is a plan view of a control unit for the new lathe.
FIG. 6 is an exploded, fragmentary view of the new lathe, showing, among other things, a power-screw assembly housed within the pre-existing hydraulic cylinder of FIGS. 1-3.
FIG. 7 is an exploded view of a ball nut shown in FIG. 6, with the main body of this nut being flipped around or turned 180° from its FIG. 6 orientation.

Referring to FIGS. 2, 3 and 6, the preferred retrofit embodiment for the present invention involves the following steps: removing the prior hydraulic drive shown in FIG. 2, including the innards from the hydraulic casing 68, the valve body 93 previously attached to the cylinder (see FIG. 3) and the drive's operating lever 44; subsequently installing a rotatable ball screw 94 inside the vacated, existing cylinder housing 68: coupling a variable-speed, reversible motor 96 to one end 97 of the screw, outside the casing; mounting a ball nut or threaded collar 98 atop the screw for axial movement inside the cylinder, wherein the nut includes a pair of spaced, parallel "push rods" 100, 102 that extend through a novel end cap 104 for the casing; connecting these rods to a new, substantially triangular yoke 106; and connecting this yoke to the pre-existing, carriage-carrying arms 54, 56 and carriage 78.

After the innards of casing 68 have been removed, the casing is prepped for installation of the ball screw 94. Two parallel rows of holes are bored into the casing on opposite sides of of the anvil supports 62, 64, 66, with one such row being shown at 108 (see FIG. 6).

Next, a pair of steel rider rails 110, 112 are inserted into the casing. Each of these rails has a longitudinal row of tapped bores (not shown) that can be registered with the holes (e.g., 108) in the casing. Cap screws (not shown) are inserted through the casing's holes and screwed into the rails' bores to fixedly attach the rails to the inside of the casing. When so secured, the rails are parallel and form a support or track for mounting the ball nut 98.

Figure 8:
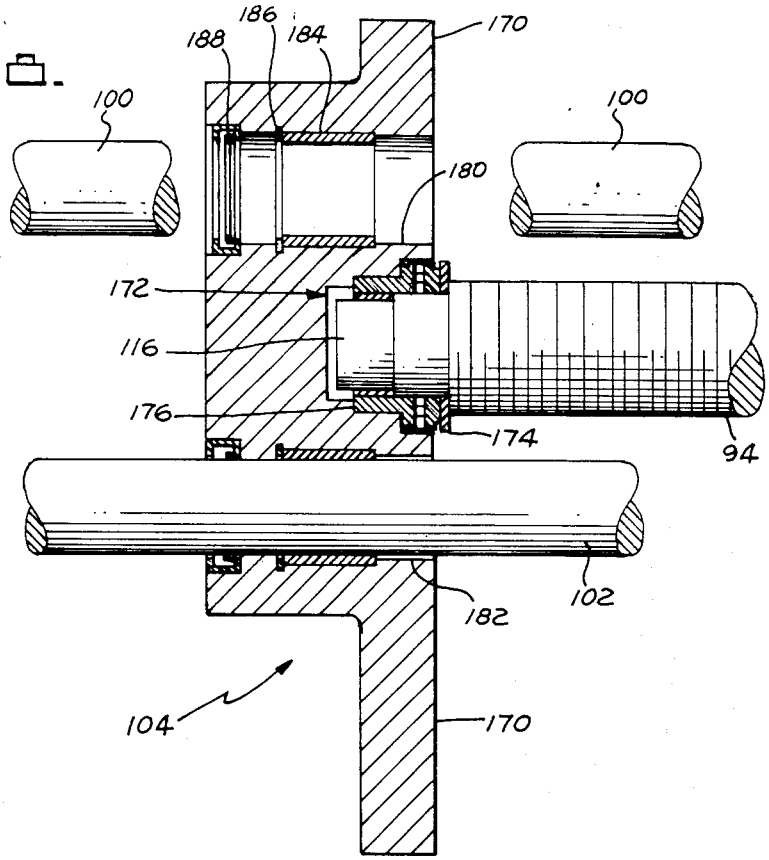
FIG. 8 is a cross-sectional view of a left-hand end cap for the cylindrical housing shown in FIG. 6.
Figure 9:
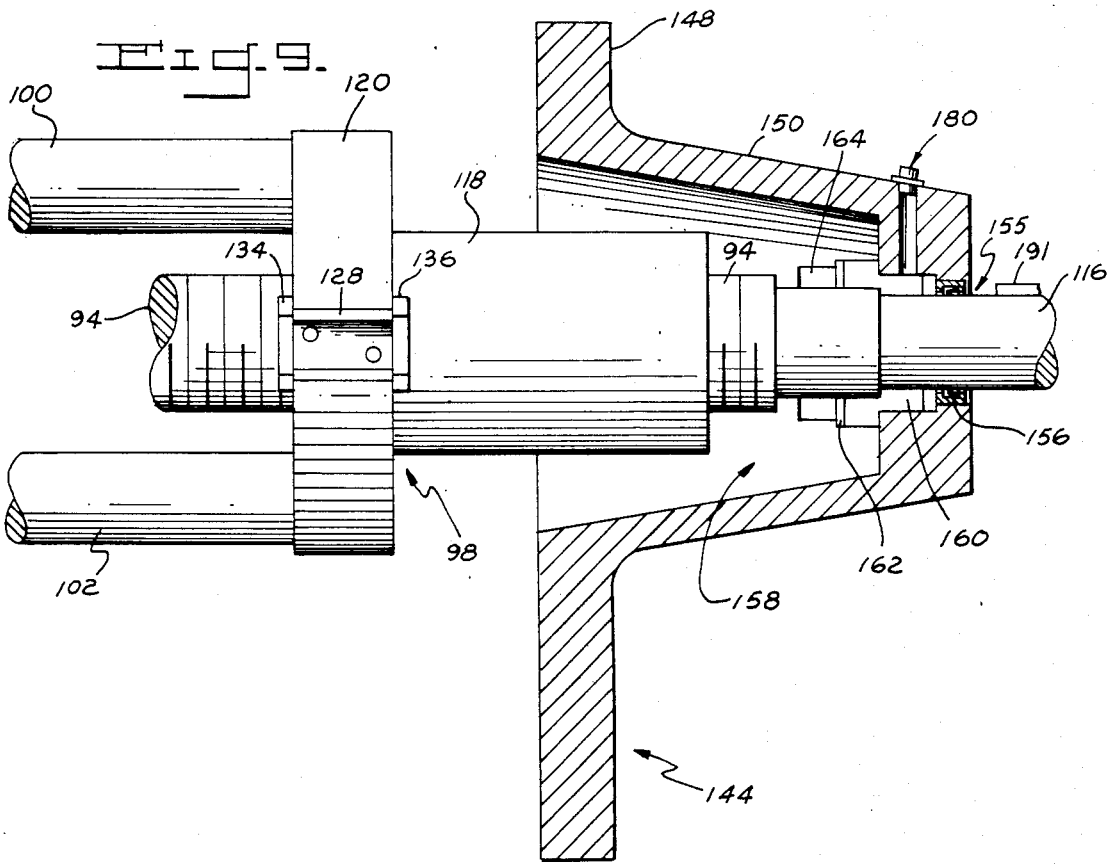
FIG. 9 is a cross-sectional view of a right-hand end cap for that housing.

The ball screw 94 and nut 98 are then inserted into casing 68. As best shown in FIGS. 6, 8 and 9, the preferred ball screw runs the entire length of the casing and has opposite, unthreaded ends 97, 116 that extend beyond it. It is a standard steel piece, Model No. 1003-6701J manufactured by Rockford Dynator of Rockford, Ill.

Ball nut 98 is also steel. It resembles an unused rivet, since it has a right-cylindrical stem 118 with a perpendicular pill-shaped end 120. As best shown in FIG. 7, the nut has a central, threaded throughbore 122. This threaded channel is preferably achieved by fixedly attaching a threaded insert inside a smooth bore by any suitable means, such as a weld or the illustrated "Dutchman" connector 124 that fits into a rim bore 125.

Pill 120 has a pair of opposing notches at 3:00 and 9:00 in FIG. 7. They are designed to hold C-shaped flange bridge inserts 126, 128 that are screwed into place (via cap screws 130, 132). To make sure the inserts stay in place, they are further secured by correspondingly shaped, left-hand and right-hand retaining plates 134, 136. These plates are welded to the pill, with one such weld being illustrated at 138. Both the inserts and retaining plates are designed so that they fit snugly around the rider rails 110, 112.

Pill 120 also has a pair of threaded bores 140, 142 at 6:00 and 12:00 in FIG. 7. They are adapted in size and shape for threaded ends (unshown) of push rods 100, 102 (see FIG. 2) to be snugly screwed into them. Thus, when the assembled ball nut 98 is attached onto screw 94, the push rods are supported cantileverly by the nut and screw.

After the ball nut 98 and screw 94 are slidably mounted on the rails 110, 112, end plates or caps 104, 144 are added to opposite ends of the casing. End cap 144 (best shown in FIG. 9) is attached to the right-hand end 147 of casing 68 shown in FIG. 6. This end cap comprises a generally key-shaped plate 148 having a oentral, raised bell housing 150. The key-shaped plate 148 has a series of holes 152 that can be aligned with tapped bores 154 in the casing's right-hand end 147. The cap can therefore be easily attached onto the end via any suitable means (not shown), e.g., by using cap screws or studs and hex nuts.

Moving from right to left in FIG. 9, the bell housing 150 of this end cap includes a central bore 155 through which the unthreaded end 116 of ball screw 94 extends. A standard rubber wiper 156, such as Model No. 503956 by Federal Mogul Corporation of Southfield, Mich., fits within the bore and surrounds the protruding end 116. It not only prevents oil from leaking out, but also prevents dust from entering the cap's chamber 158.

Continuing in our left-hand movement, cap 144 next contains the following standard parts: a radial thrust bearing 160, such as Model No. NKXR40Z1R by I.N.A. Bearing Company, Inc. of Chershaw, S.C.; a thrust washer 162, such as Model No. TWD2435 by I.N.A.; and any compatible thrust collar 164, such as the ones manufactured by the Holokrome Company of West Hartford, Conn. Since the protruding screw's end 97 has a step portion that fits through thrust bearing 160, these "thrust-support" parts 160, 162, 164 prevent horizontal shifting of the screw to the right (as viewed in FIG. 9).

For preventive maintenance, cap 144 also includes a standard grease fitting at 180 to lubricate bearing 160.

The other end cap 104 is best shown in FIG. 8. Like right-hand cap 144, this left-hand cap 104 also has a generally key-shaped plate 170 that can be screwed into casing 68. However, this cap's function is quite different.

Unlike right-hand cap 144 which permits screw end 97 to jut through it, left-hand cap 104 does not permit the opposite screw end 116 to pass through it. Instead, that screw end (116) is journaled for rotation inside a recess 172 by a standard thrust washer 174 and radial thrust bearing 176. Note that the screw end 116 is stepped, as it passes through bearing 176, to prevent lateral movement.

While screw end 116 is not permitted to extend through cap 104, the slidable push rods 100, 102 are. These rods pass through upper and lower throughbores 180, 182, where they are supported for horizontal movement.

Bores 180, 182 contain identical parts. For example, upper throughbore 180 includes a standard busing 184 and snap ring 186. Further, each bore includes an oil seal or rubber wiper 188, like wiper 156 in FIG. 9.

After the caps are secured, the protruding end 97 of screw 94 is drivingly connected to the reversible speed motor (preferably, Model No. BM3714T by the Baldor company of Fort Smith, Ark.). In the illustrated embodiment, this is achieved by keying the protruding end 97 into an intermediate right-angle gear box 190. The box is standard (preferably, Model No. 12HB1-SN20 by Browning Manufacturing Division of Emerson Electric Co., Maysville, Ky.) and the keying is accomplished via a key 191 that fits into a slot (not shown) in bushing coupling 192. The coupling, in turn, is fixed onto a rotatable, output shaft 194 of box 190, while the motor 96 is fixed onto an input or driven shaft 196 of the box.

As best shown in FIG. 4, motor 96 is supported atop pulp-grinder 12, at a right angle to screw 94, via a standard motor mount 198. At the opposite end of the casing, away from the "motor end", the push rods 100, 102 are connected to new yoke 106. This yoke resembles a "rack" for pool balls, but with the lead end 199 blunted.

To attach the rods 100, 102, threaded ends (not shown) are passed through a vertical pair of throughbores 200, 202 in the blunted end. Then, hex nuts 204, 206 are screwed onto these protruding ends.

Once the rods are connected, the conversion from the hydraulic lathe 32 of FIGS. 1–3 to the illustrated, new electric one 10 is basically completed. The last remaining step is simply to attach the new yoke 106 to the pre-existing, carriage-carrying arms 54, 56. This is achieved by passing unshown threaded ends of the arms through another vertical pair of holes 212, 214 in the yoke 106 and then screwing on associated hex nuts (not shown).

To operate the electric lathe 10, a user selectively runs the motor 96 via a standard electronic control 216, such as Inverter Unit Model No. VAC2004, manufactured by Zycron Systems, Inc. of West Haven, Conn. As shown in schematic form, this unit includes a start button 218; a stop button 220; a run/jog switch 222; a speed-control dial 224; and a forward/reverse switch 226.

In the following description, the term "forward" will be used to describe movement of the lathe 10 in a left-to-right direction in FIG. 4.

With the run/jog switch 222 in the "run"position, pressing down on the start button 218 causes the lathe 10 to move in either the forward or reverse direction. With the run/jog switch 222 in the "jog" position, the start button 218 will cause the lathe to move in either the forward or reverse direction, but only as long as the user holds this button in. When the user lets up on it, the lathe will stop.

Stop button 220 is used to halt the lathe when it is moving in either the forward or reverse direction. This button also serves as a reset if the control is overloaded.

When utilizing the run/jog switch 22, the "run" position should be employed whenever dressing or sharpening stone 18. The "jog" position should be used for positioning the wheel 34 at a particular location on the stone.

Speed control 224 takes the place of the pre-existing water valve found in hydraulic lathe 32. It sets the optimum speed of lathe 10. Once it has been set for a sharpening pass, it must not be re-adjusted until the stone is again "turned down". When turning down the stone with the illustrated motor, this control should be set for a slow, smooth speed of about 15–20 seconds.

Forward/reverse switch 226 has two positions: a forward position and a reverse one. Forward position allows the lathe to move from west to east in FIG. 4. The lathe's movement can be reversed by simply flipping the switch.

In the preferred embodiment, a pair of standard limit switches (not shown) are located near opposite ends of cylindrical housing 68. They are mounted atop rail 112. One of these switches is preset to stop the lathe's forward movement at the exact point where the trailing burr (not shown) first touches the stone 18 in a sharpening pass. The other switch has been preset to stop the lathe's reverse movement when the lathe is closed.

To sharpen the stone's grooves, the inverter unit 216 is first switched on. Then, the electric lathe 10 is advanced in either the "run" or "jog" position to the point on the stone 18 where a user wishes to get his "touch point". After the touch is achieved, its position is read by looking at pointer 42.

Next, the wheel is backed off the stone and the lathe is run to its farthest, left-hand point in FIG. 4. It should stop in the correct spot if its associated limit switch has not been changed.

Inverter switches 222, 226 are set to their "run" and "reverse" positions. Then, the wheel 34 is lowered slowly to the proper depth, and its housing 36 is locked in place by pulling down wrench handle 228 (see FIG. 3). After this set up has been achieved, start button 218 is merely pushed and held to complete a single pass across the stone.

Once the initial pass is completed, it is repeated until the desired degree of resharpening is achieved. To start a new pass, the wheel is lifted away from the stone and again run back to its left-hand point. Then, the rehoning steps of the last paragraph are begun anew.

Once the pass is completed, the burr is lifted away from the stone and again run back to its left-hand point. It is then jogged over to the next groove and the rehoning process of the last paragraph is repeated.

It will be readily understood by those skilled in the art that obvious struotural modifications can be made without departing from the spirit of the invention. For example, instead of being mounted at a right angle, the drive motor 96 can be mounted in a parallel arrangement with screw 94; and, because the motor is reversible, it can be mounted either facing toward or away from the screw. Accordingly, reference should be made primarily to the accompanying claims rather than the foregoing specification to determine the scope of the invention.

Having thus described the invention, what is claimed is:

1. In a pulp-grinding machine of the type having a rotatable, cylindrical grinding stone with an overlying hydraulic lathe for sharpening helical grooves found in the stone's grinding surface, wherein the lathe has a movable carriage that is designed to be lowered so that a plurality of burrs on the carriage fits into the grooves to resharpen the grooves as the carriage makes an axial pass across the stone, a method for converting a pre-existing hydraulic lathe for such machinery into an electric one, said method comprising:

a. removing the innards from a cylindrical casing of the hydraulic lathe;

b. removing a valve body previously attached to the cylinder;

c. inserting a pair of rider rails into the vacated casing and fixedly attaching them to the inside of the casing so that the rails are parallel to one another;

d. subsequently installing a rotatable ball screw inside the vacated cylinder;

e. coupling a variable speed, reversible motor to one end of the screw, outside the cylinder;

f. mounting a threaded ball nut atop the screw for axial movement inside the cylinder, wherein the nut includes a pair of parallel guide notches that ride along the rails to prevent the nut from twisting;

g. attaching a pair of spaced, parallel rods onto the nut, whereby one end of each rod is attached to the nut and the rod's other end extends beyond the casing;

h. connecting the "extruding" end of each rod to a yoke; and i. connecting this yoke to the pre-existing, carriage-oarrying arms and carriage of the former hydraulic lathe.

2. The method of claim 1 further including the step of securing end plates onto opposite ends of the casing to rotatably support the screw; wherein one of the end plates contains a throughbore through which an end of the screw extends and is coupled to the motor; and the other end plate includes a recess for rotatably supporting an opposite end of the screw and a pair of vertically spaced throughbores through which the rods extend before they are connected to the yoke.

3. A method of converting a hydraulic lathe for a pulpgrinding machine into an electric lathe, said method comprising:

a. removing the innards from a cylindrical casing of the hydraulic lathe;

b. removing a valve body previously attached to the cylinder;

c. inserting a pair of rider rails into the vacated casing and fixedly attaching them to the inside of the casing so that the rails are parallel to one another;

d. subsequently installing a rotatable ball screw inside the vacated cylinder;

e. coupling a variable speed, reversible motor to one end of the screw, outside the cylinder;

f. mounting a threaded ball nut atop the screw for axial movement inside the cylinder, wherein the nut includes a pair of parallel guide notches that ride along the rails to prevent the nut from twisting;

g. attaching a pair of spaced, parallel rods onto the nut, whereby one end of each rod is attached to the nut and the rod's other end extends beyond the casing;

h. connecting the "extruding" end of each rod to a yoke; and i. oonnecting this yoke to the pre--existing, oarriage-carrying arms and carriage of the former hydraulic lathe.

4. The method of claim 3 further including the step of securing end plates onto opposite ends of the casing to rotatably support the sorew; wherein one of the end plates contains a throughbore through which an end of the screw extends and is coupled to the motor; and the other end plate includes a recess for rotatably supporting an opposite end of the screw and a pair of vertically spaoed throughbores through which the rods extend before they are connected to the yoke.

5. A method of converting a hydraulic lathe for a pulprinding machine into an electric lathe, said method comprising:

a. removing the innards from a cylindrical oasing of the hydraulic lathe;

b. removing a valve body previously attached to the cylinder;

c. subsequently installing a rotatable ball screw inside the vacated cylinder;

d. coupling a variable speed, reversible motor to one end of the screw, outside the cylinder;

e. mounting a threaded ball nut atop the screw for axial movement inside the cylinder;

f. attaching at least one rod onto the nut, whereby one end of the rod is connected to the nut and another extends beyond the casing;

g. connecting the "extending" end of the rod to a yoke; and h. connecting this yoke to the pre-existing, carriage-carrying arms and carriage of the former hydraulic lathe.

6. The method of claim 5 further comprising:

i. prior to step (c), inserting a pair of rider rails into the vacated casing and fixedly attaching them to the inside of the casing so that the rails are parallel to one another; and j. notching the outer surface of the nut so that it includes a pair of parallel guide notches that ride along the rails to prevent the nut from twisting.

7. The method of claim 5 wherein the method further comprises a pair of spaced, parallel rods that are connected onto the nuts.

8. The method of claim 7 further including the step of securing end plates onto opposite ends of the casing to rotatably support the screw; wherein one of the end plates contains a throughbore through which an end of the screw extends and is coupled to the motor: and the other end plate includes a recess for rotatably supporting an opposite end of the screw and a pair of vertically spaced throughbores through which the rods extend before they are connected to the yoke.

9. In a pulp-grinding machine of the type having a rotatable, cylindrical grinding stone for breaking down logs and grinding them into fine particles, wherein the stone has a series of helical grooves in its grinding surface and the machine has a movable carriage that is designed to be lowered so that a plurality of burrs on the carriage fits into the grooves to resharpen the grooves as the carriage makes an axial pass across the stone, the improvement comprising an electric drive for selectively moving the carriage along the stone, said drive comprising:

a. a cylindrical casing fixedly mounted atop the pulp-grinding machine;

b. a pair of rider rails located inside the casing and fixedly attached to the inside of the casing so that the rails are parallel to one another;

c. a ball screw having a major portion housed within the cylinder;

d. a variable speed, reversible motor drivingly connected to an end of the screw, outside the casing;

e. a threaded ball nut mounted atop the screw for axial movement inside the casing, wherein the nut includes a pair of parallel guide notches that straddle respective rails to prevent the nut from twisting during its axial movement;

f. a pair of spaced, parallel push rods, wherein one end of each rod is removably attached to the nut and the other end of each rod protrudes beyond the casing;

g. a yoke located outside the casing and removably connected to the protruding end of each rod;

h. a pair of spaced, upper and lower carriage-carrying arms, said arms having opposite ends removably attached to both the yoke and the carriage with the burrs; and i. a pair of end plates removably attached onto opposite ends of the casing to rotatably support the screw between them, wherein one of the end plates includes a throughbore through which an end of the screw extends and is coupled to the motor, and the other end plate includes both a recess for rotatably supporting an opposite end of the screw and a pair of vertically spaced holes through which the push rods extend before they are connected to the yoke.

10. In a pulp-grinding machine of the type having a rotatable, cylindrical grinding stone for breaking down logs and grinding them into fine particles, wherein the stone has a series of helical grooves in its grinding surface and the machine has a movable carriage that is designed to be lowered so that a plurality of burrs on the carriage fits into the grooves to resharpen them as the carriage makes an axial pass across the stone, the improvement comprising an electric drive for selectively moving the carriage along the stone, said drive comprising:

a. a cylindrical casing fixedly mounted atop the pulp-grinding machine;

b. a ball screw having a major portion housed within the cylinder;

c. a variable speed, reversible motor drivingly connected to an end of the screw, outside the casing;

d. a threaded ball nut mounted atop the screw for axial movement inside the casing;

e. at least one rod having an end removably connected to the nut and another end that protrudes beyond the casing;

f. a yoke located outside the casing and removably connected to the protruding end of the rod;

g. a pair of spaced, upper-- and lower carriage-carrying arms, said arms having opposite ends removably attached to both the yoke and the carriage with the burrs; and h. a pair of end plates removably attached onto opposite ends of the casing to rotatably support the screw between them, wherein one of the end plates includes a throughbore through which an end of the screw extends and is coupled to the motor, and the other end plate includes a recess for rotatably supporting an opposite end of the screw and a throughbore through which the rod extends before it is connected to the yoke.

11. The apparatus of claim 10, wherein the apparatus further comprises a pair of rider rails located inside the casing and fixedly attached to the inside of the casing so that the rails are parallel to one another; and the ball screw has a pair of guide notches in its outer surface that straddle respective rails to prevent the nut from twisting during its axial movement during the casing.

* * * * *